US005592832A

United States Patent [19]

Herron et al.

[11] Patent Number: 5,592,832

[45] Date of Patent: Jan. 14, 1997

[54] PROCESS AND APPARATUS FOR THE PRODUCTION OF MODERATE PURITY OXYGEN

[75] Inventors: Donn M. Herron, Fogelsville; Rakesh Agrawal, Emmaus; Jianguo Xu, Fogelsville, all of Pa.

[73] Assignee: Air Products and Chemicals, Inc., Allentown, Pa.

[21] Appl. No.: 538,541

[22] Filed: Oct. 3, 1995

[51] Int. Cl.[6] ..... F25J 3/00

[52] U.S. Cl. ..... 62/646; 62/903; 165/166

[58] Field of Search ..... 62/646, 903; 165/166

[56] References Cited

U.S. PATENT DOCUMENTS

| | | | |
|---|---|---|---|
| 2,861,432 | 11/1958 | Haselden | 62/29 |
| 3,568,461 | 3/1971 | Hoffman | 62/42 |
| 3,568,462 | 3/1971 | Hoffman et al. | 62/42 |
| 3,612,494 | 10/1971 | Toyama et al. | 261/112 |
| 3,756,035 | 9/1973 | Yearout | 62/22 |
| 3,983,191 | 9/1976 | Schauls | 261/114 R |
| 3,992,168 | 11/1976 | Toyama et al. | 62/42 |
| 4,025,398 | 5/1977 | Haselden | 203/25 |
| 4,234,391 | 11/1980 | Seader | 203/76 |
| 4,308,043 | 12/1981 | Yearout | 62/13 |
| 5,144,809 | 9/1992 | Chevalier et al. | 62/36 |
| 5,207,065 | 5/1993 | Lavin et al. | 62/11 |
| 5,291,738 | 3/1994 | Waldrop | 62/903 |
| 5,385,203 | 1/1995 | Mitsuhashi et al. | 62/903 |
| 5,410,885 | 5/1995 | Smolarek et al. | 62/25 |
| 5,438,836 | 8/1995 | Srinivasan et al. | 165/166 |

OTHER PUBLICATIONS

Trans. Instn Chem. Engrs, vol. 44, 1966 "An Approach to Thermodynamic Reversibility in the Fractionation of Liquid Air".

International Advances in Cryogenic Engineering, Proceedings of the 1964 Cryogenic Engineering Conference (Sections M–U), pp. 405–410 "An Approach to Reversible Fractionation: Tests With Overflow Packing" Applied to Air Separation.

*Primary Examiner*—Ronald C. Capossela
*Attorney, Agent, or Firm*—Willard Jones, II

[57] ABSTRACT

The present invention relates to a cryogenic process and apparatus for production of an oxygen product from air, characterized in that a multiple passage plate-fin heat exchanger having at least two sets of passages is used to effectuate the rectifying and stripping functions, wherein one set of passages comprises a continuous-contact rectification dephlegmator which rectifies the separator vapor and produces the enriched-nitrogen rectifier overhead and the crude liquid oxygen bottoms; wherein a second set of passages comprises a continuous-contact stripping dephlegmator which strips the oxygen-enriched liquid to produce the nitrogen-enriched stripper overhead and the oxygen product; wherein reflux of the rectification device and boilup for the stripping device is provided, at least in part, by indirect heat exchange between and along said two sets of passages, thereby producing a thermal link between the rectification dephlegmator and the stripping dephlegmator.

20 Claims, 10 Drawing Sheets

PROCESS AND APPARATUS FOR THE PRODUCTION OF MODERATE PURITY OXYGEN

TECHNICAL FIELD

The present invention is related to a process for the cryogenic distillation of air using dephlegmation to produce moderate purity oxygen.

BACKGROUND OF THE INVENTION

The production of oxygen from air, using cryogenic methods, is both capital and power intensive. Presently, standard double column-type air separation plants are commonly used for the production of moderate purity oxygen (85% to 98%). With the improvement of non-cryogenic technologies (such as adsorption), there is an acute and growing need to reduce both power consumption and capital cost of cryogenic plants at this level of oxygen purity. A dual-dephlegmator cycle (i.e., rectification and stripping cycle) offers the potential to reduce power but may not reduce capital cost unless it is implemented effectively. It is the object of this invention to provide a process/apparatus which provides savings in both capital and power.

Numerous dephlegmator processes are known in the art; among these are the following:

U.S. Pat. No. 2,861,432 discloses a dual-dephlegmator cycle for oxygen production. The most relevant embodiment of that invention is illustrated in FIG. 1. The key features of U.S. Pat. No. 2,861,432 are as follows (identifier numbers correspond to FIG. 1): A high pressure rectification dephlegmator (23) accepts chilled feed air at the bottom (28) and produces enriched nitrogen vapor as overhead (25) and crude liquid oxygen as bottoms (32). A low pressure stripping dephlegmator (24) accepts a liquid flowing from the fractionating column (21) at the top, produces enriched oxygen as a liquid bottoms product (26), and rejects vapor out the top which flows up into the fractionating column (21). The rectifying and stripping dephlegmators are in thermal contact to facilitate heat exchange. A high pressure condenser (34) converts the rectification dephlegmator overhead (25) from vapor to liquid (this liquid is used as top reflux to the fractionating column (21)). This condenser consists of tubes (34) immersed in liquid in the column (21). The fractionating column (21), which carries-out both rectification and stripping, is also present. Boilup for the column is provided by vaporizing some of the liquid on the lower trays. The heat transfer device used is of the tube type (34). The heat for vaporization comes from the heat rejected by the condensation of rectification dephlegmator overheads. This column accepts the enriched, liquid nitrogen from the high pressure condenser as the top most feed, liquid air (31) as an intermediate feed, crude liquid oxygen from the high pressure dephlegmator (32) plus expander air (41) as the third feed. Vapor rejected from the low pressure stripping dephlegmator flows into the lower trays. The liquid from the fractionation column is the feed to the low pressure stripping dephlegmator while the overheads is a nitrogen enriched "waste" stream (42). The liquid air feed is produced by vaporizing the liquid oxygen product from the bottom of the low pressure stripping dephlegmator. The vaporization/condensation takes place in a separate exchanger (27). Two (2) pressure levels of air enter the plant. Eighty percent (80%) of the air enters at the lower pressure (at about 60 psia). After chilling, the lower pressure feed is split into two streams. Essentially, half of this flow is expanded to provide refrigeration, the other half is sent to the rectification dephlegmator. Twenty percent (20%) of the air enters at a higher pressure (at about 70 psia) and is condensed against boiling oxygen product. The pressure of the oxygen product is near atmospheric pressure.

U.S. Pat. No. 2,861,432 also discloses an apparatus which is assembled with a material called overflow packing. The apparatus, which could be used to combine the stripping and rectification dephlegmator functions, is contained within the low pressure distillation column with the stripping dephlegmator side open to the column and the other enclosed. A further discussion of overflow packing is disclosed by Winteringham et al, in an article in Trans Instn Chem Engrs, page 55, Vol 44, 1966.

Despite the foregoing, there are numerous disadvantages associated with the teachings of U.S. Pat. No. 2,861,432; among these are the following: Overflow packing has limited vapor capacity and low mass transfer/heat transfer efficiency because so much liquid is held-up. The "packing unit" is inserted within the column itself which represents poor use of volume (a rectangular device in a circular container). The overflow packing is inappropriate for oxygen service because it presents a series of liquid accumulation points for hydrocarbons to concentrate. Furthermore, the use of tubes-immersed-in-liquid to operate the reflux condenser (34) is a mechanically complex proposition.

U.S. Pat. No. 4,025,398 discloses a process and (primarily) various devices for heat integrating rectification and stripping sections of distillation columns with heat exchange equipment running between individual distillation stages of two columns.

U.S. Pat. No. 3,756,035 discloses a process wherein separation takes place in a plurality of fractionating zones with the respective fractionating zones being connected in adjacent side-by-side indirect heat exchange relation with one another. U.S. Pat. No. 3,756,035 also discloses that the fractionating passages can be channels bearing the liquid-vapor mixture being separated in the column. Such channels may be constructed in a manner of a perforated fin compact heat exchanger, producing the effect of distillation column trays. This type of heat exchanger arrangement is also described in *International Advances in Cryogenics*, Vol. 10, pp 405, 1965. Though the reference is somewhat vague, it is believed to be referring to overflow packing.

U.S. Pat. No. 4,308,043 also relates to partial heat integration of rectification and stripping sections.

U.S. Pat. No. 4,234,391 discloses a method and apparatus which thermally links the stripping and rectifying sections of the same column. The apparatus consists of a trayed column with a wall running down the centerline and heat exchange tubes which transfer energy from one tray to another.

U.S. Pat. No. 3,568,461 discloses a fractionating apparatus using serrated fins for use in adiabatic or differential distillation.

U.S. Pat. No. 3,568,462 also discloses a fractionating apparatus made from perforated fin in the hardway flow orientation.

U.S. Pat. No. 3,612,494 discloses a gas-liquid contacting device using a plate-fin exchanger. U.S. Pat. No. 3,992,168 discloses a means of vapor-liquid distribution for plate-fin fractionating devices.

U.S. Pat. No. 3,983,191 describes the use of plate-fin exchanger for non-adiabatic rectification.

U.S. Pat. No. 5,144,809 discloses a rectification dephlegmator for nitrogen production using a plate-fin exchanger.

There is no stripping dephlegmator. The dephlegmator produces nitrogen at, essentially, feed air pressure. Crude liquid oxygen is boiled against the dephlegmating nitrogen such that no separation is performed on the crude liquid oxygen.

U.S. Pat. No. 5,207,065 also discloses a rectification dephlegmator for nitrogen production based on a plate-fin heat exchanger.

Finally, U.S. Pat. No. 5,410,855 discloses a double column cryogenic rectification system wherein the lower pressure column bottoms undergo additional stripping within a once-through downflow reflux condenser by countercurrent direct contact flow with vapor generated by condensing higher pressure column shelf vapor.

SUMMARY OF THE INVENTION

The present invention relates to a cryogenic process for production of an oxygen product from air, wherein the air is compressed, purified to remove contaminants which freeze out at cryogenic temperatures and cooled to near its dew point, wherein the cooled, purified, compressed air is fed to a separator, wherein separator vapor is rectified into a nitrogen-enriched rectifier overhead and a crude liquid oxygen bottoms; wherein an oxygen-enriched liquid is stripped to produce a nitrogen-enriched stripper overhead and the oxygen product, characterized in that a multiple passage plate-fin heat exchanger having at least two sets of passages is used to effectuate both the rectification and stripping functions, wherein one set of passages comprises a continuous-contact rectification dephlegmator which rectifies the separator vapor and produces the enriched-nitrogen rectifier overhead and the crude liquid oxygen bottoms; wherein a second set of passages comprises a continuous-contact stripping dephlegmator which strips the oxygen-enriched liquid to produce the nitrogen-enriched stripper overhead and the oxygen product; wherein reflux for the rectification device and boilup for the stripping device is provided, at least in part, by indirect heat exchange between and along said two sets of passages, thereby producing a thermal link between the rectification dephlegmator and the stripping dephlegmator.

In the process, the oxygen product can be removed from the stripping dephlegmator as a liquid or as a vapor.

In the process, the first set of passages can further comprise a condensing zone located above the rectification dephlegmator; wherein the nitrogen-enriched rectifier overhead is at least partially condensed in the condensing zone and wherein the refrigeration is provided, at least in part, by indirect and continuous heat exchange with an upper portion of the second set of passages (stripping dephlegmator), thereby producing a thermal link between the condensing zone and the stripping dephlegmator.

In the process, the crude liquid oxygen bottoms from the rectification dephlegmator, the at least partially condensed nitrogen-enriched rectifier overhead from the condensing zone (if present), and the nitrogen-enriched stripper overhead can be fed to a (supplemental) distillation column for fractionation, thereby producing a waste nitrogen-enriched overhead and the oxygen-enriched liquid.

In the process when the oxygen product is liquid, the oxygen product can be subsequently vaporized by heat exchange against a second air stream which is condensed by the heat exchange and wherein the condensed second air stream is used as an intermediate feed to the (supplemental) distillation column. Additionally, the oxygen product can be vaporized within a third set of passages in the multiple passage plate-fin heat exchanger to produce a vapor and wherein the heat of vaporization is provided, at least in part, by heat exchange with the rectification dephlegmator passages.

In the process, the purified, compressed air can be split into two portions before cooling, wherein the first portion is cooled and fed to the separator, wherein the second portion is further compressed, cooled and split into two substreams; wherein the first substream is the second air stream which is condensed against the vaporizing oxygen product and wherein the second substream is expanded to recover work and provide refrigeration prior to being fed to the distillation column.

Finally, in the present invention, the rectification dephlegmator passages can be shorter in length than the stripping dephlegmator passages and arranged so as to produce an adiabatic zone within the top of the stripping dephlegmator passages.

The present invention also relates to a cryogenic oxygen production apparatus comprising a multiple passage plate-fin heat exchanger having at least two sets of vertically oriented passages separated by parting sheets and having a bottom and a top, wherein the first set of passages comprises a continuous-contact rectification dephlegmator zone containing finnings and a condensing zone which is located above and separated from the rectification dephlegmator zone; wherein the second set of passages comprises a continuous-contact stripping dephlegmator zone; wherein the first and second set of passages are arranged such that each passage of said first set of passages is in thermal communication across a parting sheet with at least one passage of said second set of passages; two phase distributing means to introduce vapor into the bottom of and remove liquid from the first set of passages and a liquid distributing means to introduce liquid into the top of the second set of passages and withdraw vapor.

In the apparatus, a solid bar, a bar containing apertures and a hardway tinning can be used to separate the rectification dephlegmator zone and the condensing zone.

DETAILED DESCRIPTION OF THE PRESENT INVENTION

The present invention is a process for separating air which carries-out rectifying dephlegmation and stripping dephlegmation within a single plate-fin exchanger. Further, the condensation of the nitrogen reflux may also be carried-out in the subject exchanger, wherein the condensation zone and the rectification zones are present in the same passages. Therefore, condensation is accomplished by heat exchange against the stripping passages.

Typically, the process of the present invention is operated such that the refrigeration requirement for high pressure rectification and condensation are identical in magnitude to the heat input requirement for low pressure stripping. The pressure difference between the "high" and "low" pressure passages provides the means to achieve the temperature driving force needed to transfer heat.

Process Embodiments

To better understand the present invention, attention is directed to FIGS. 2*a* through 3*c*.

Figure 1:
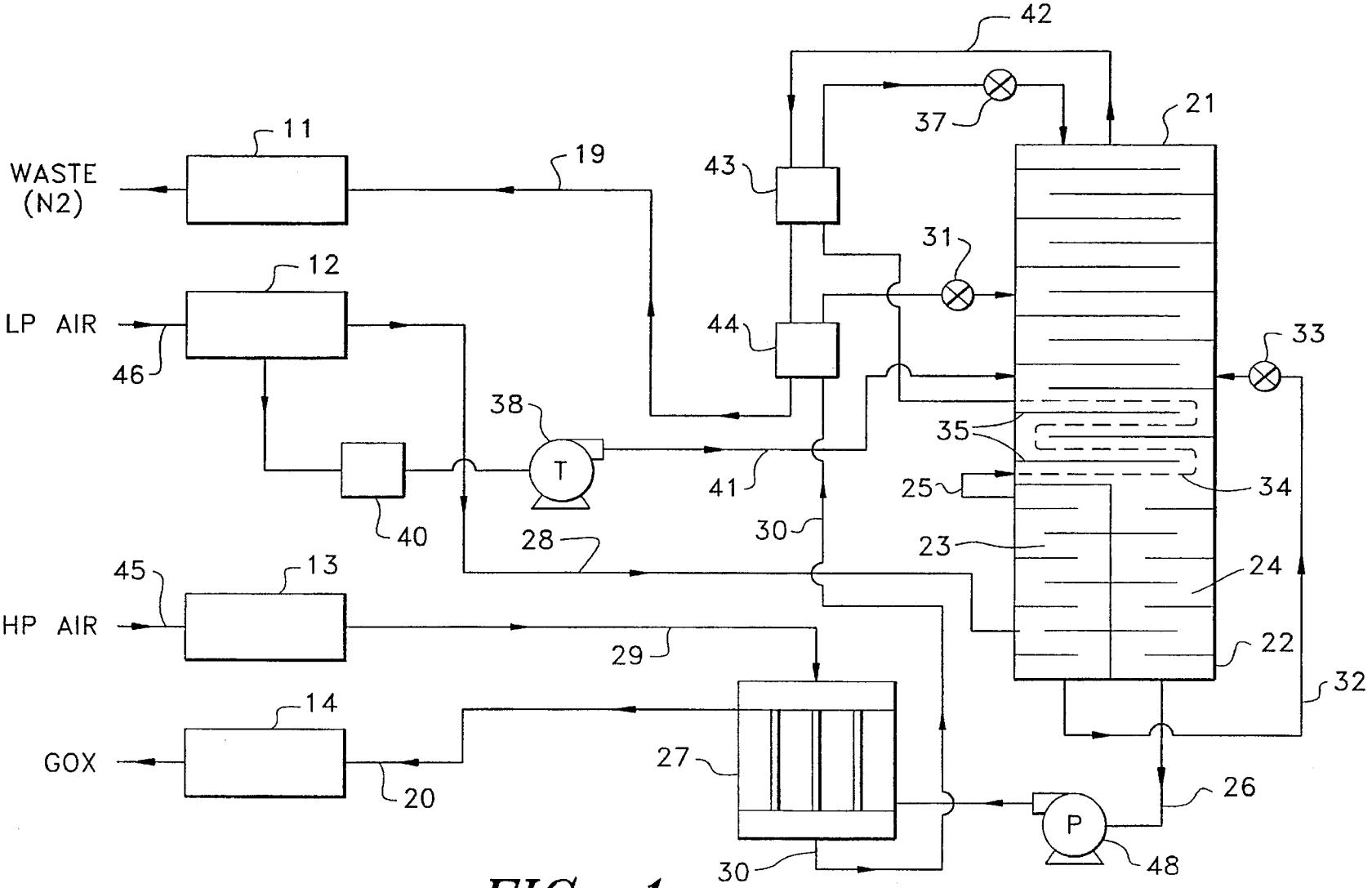
FIG. 1 is a schematic drawing of an embodiment taught in U.S. Pat. No. 2,861,432.
Figure 2B:
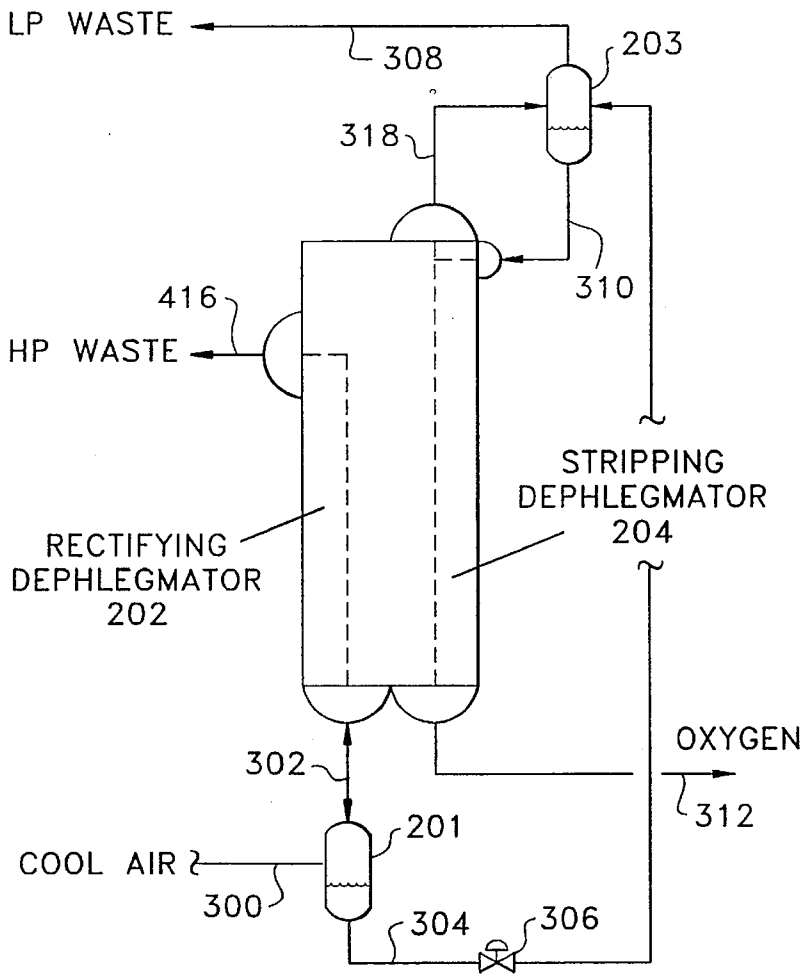
FIGS. 2*a* through 2*d* and 3*a* through 3*c* are schematic drawings of embodiments of the present invention.
Figure 2A:
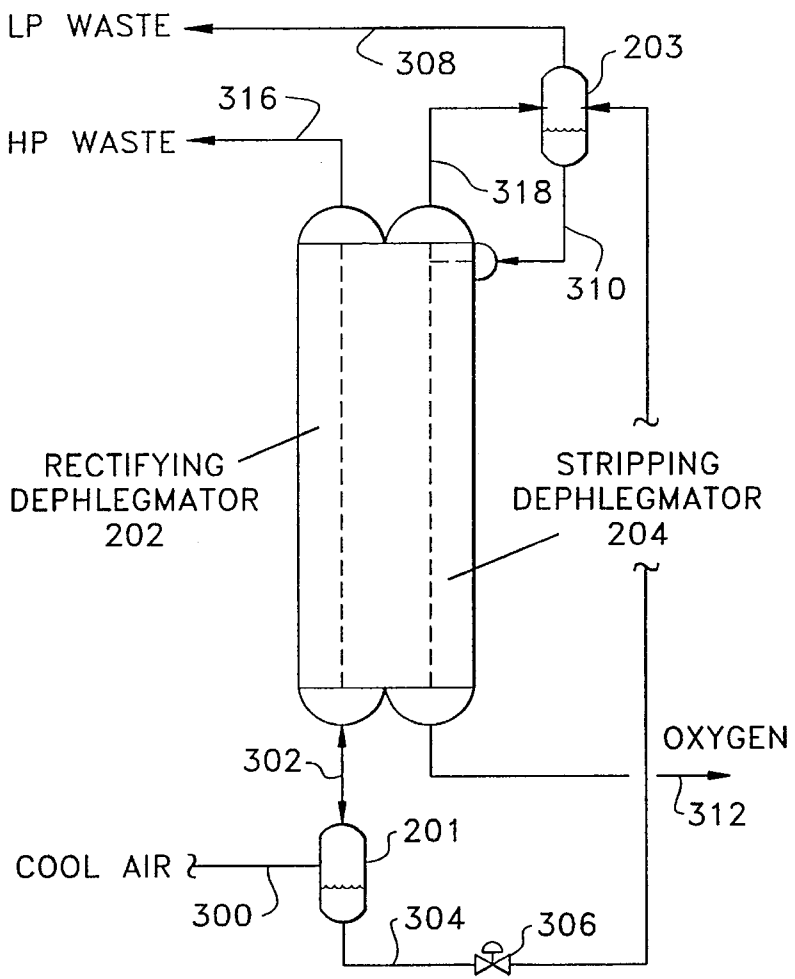

The broadest embodiment is shown in FIG. 2*a*. In FIG. 2A, feed air, which has been purified of contaminates which would freeze out at cryogenic temperatures and which has been cooled to near its dew point, is introduced via line 300 to phase separator 201 where it is separated into a liquid portion and a vapor portion.

The vapor portion from phase separator 201 flows via line 302 into the bottom of rectification dephlegmator 202. Rectification dephlegmator consists of a multitude of passages; each passage contains fins. As the vapor rises through the finning, it is partially condensed by indirect heat transfer through the parting sheet. The condensate drains down the passages and into 201 via line 302 where it combines with the liquid portion to become the crude liquid oxygen. The counterflow of vapor and liquid in the passages provides the means for fractionation—as a result, the vapor leaving the top of the rectification dephlegmator via line 316 is enriched in nitrogen (i.e., 90 mol % or greater) and called the high pressure (HP) waste. The high pressure waste would be normally warmed to recover refrigeration and could then be either used "as is" or expanded and rejected. The bulk of the oxygen in the air is recovered as crude liquid oxygen from phase separator 201.

The crude liquid oxygen is removed from phase separator via line 304, reduced in pressure across valve 306 and introduced into second phase separator 203.

The liquid portion from phase separator 203 flows via line 310 into the top of stripping dephlegmator 204. Stripping dephlegmator 204 also consists of a multitude of passages with fins. As the liquid falls through the finning, it is partially vaporized by indirect heat transfer through the parting sheet. The vapor "boilup" rises up through the passages and is eventually fed via line 318 to phase separator 203. In the passages, the counterflow of vapor and liquid provides the means for fractionation—as a result, the material leaving the bottom of stripping dephlegmator 204 via line 312 is enriched in oxygen (i.e., 85 mol % or greater) and becomes the oxygen product. The vapor leaving stripping dephlegmator 204 via line 318 is enriched in nitrogen in relationship to the crude liquid oxygen. The vapor portion is removed from phase separator 203 via line 308 and constitutes the low pressure (LP) waste. The low pressure waste would normally be warmed to recover refrigeration and then vented.

The dual-dephlegmator process of the present invention accomplishes it results by matching the heat load of the rectifier with that of the stripper.

Although shown that way in FIG. 2*a*, it is not necessary that the rectification and stripping dephlegmator passages be of equal length. For example, FIG. 2*b* shows the passages of rectification dephlegmator 202 as being shorter than the passages of stripping dephlegmator 204. In this case, the high pressure waste stream exits at a lower level, thereby creating an adiabatic distillation zone in the passages of stripping dephlegmator 204 immediately below the liquid feed point.

Figure 2D:
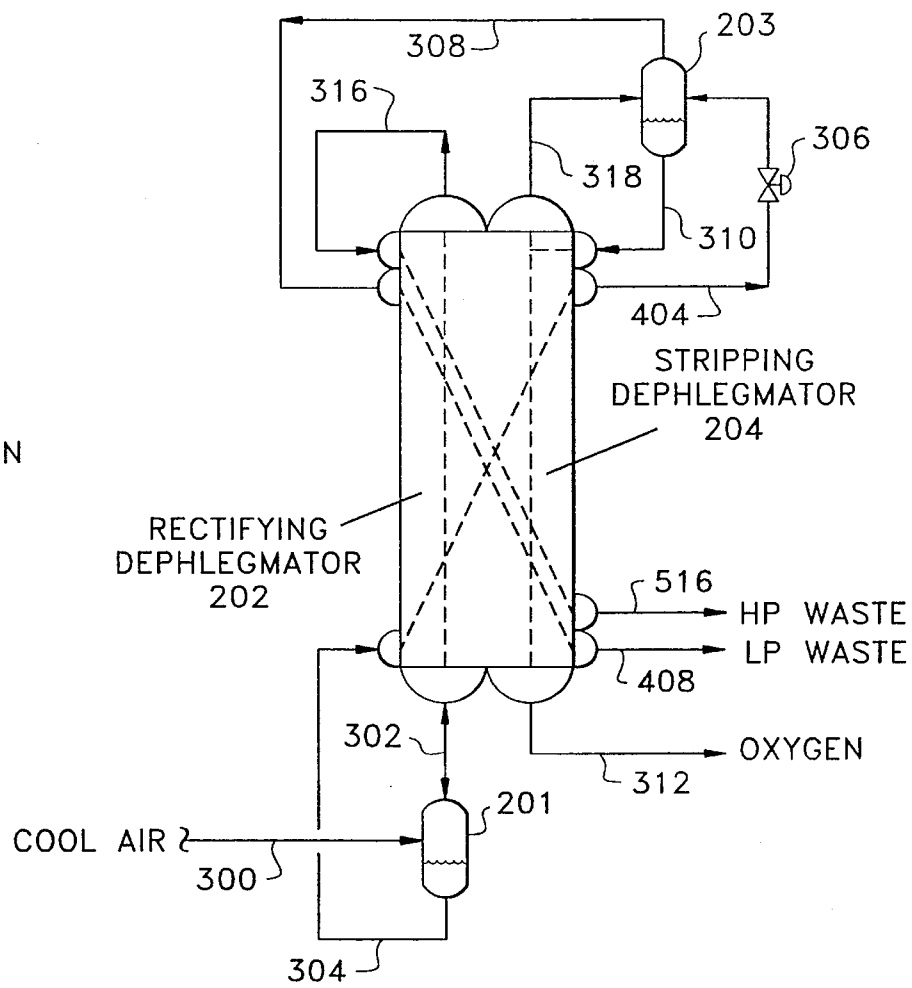
Figure 2C:
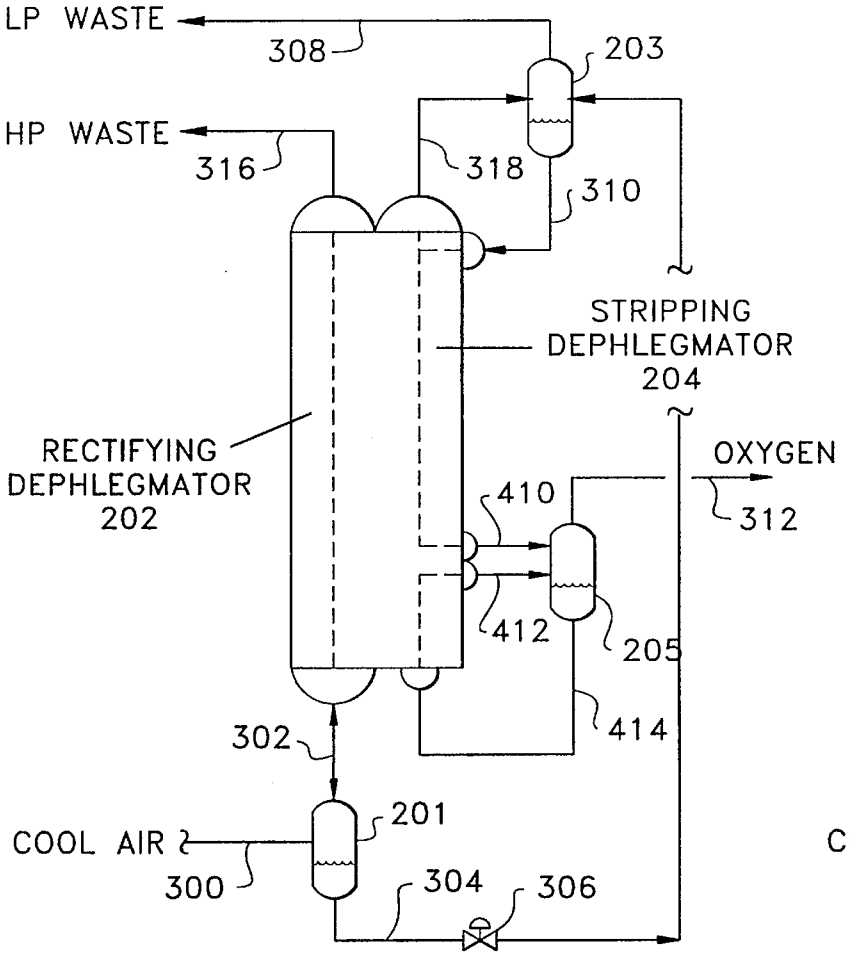

In the previous embodiments, the state of the oxygen product leaving stripping dephlegmator 204 has not been specified. Although the oxygen may normally exit as a liquid (in which case the feed, in line 300, would be two-phase), there is no process reason why the oxygen product cannot be withdrawn as a vapor (in which case the feed would be essentially saturated vapor). Unfortunately, boiling a liquid to dryness often requires significant heat exchanger length. In this case, it may be advisable to remove the oxygen product as a liquid part-way down the exchanger and substitute a thermosyphon boiling zone in the passages for the lower portion of the stripping dephlegmator. This embodiment is shown in FIG. 2*c*. With reference to FIG. 2*c*, external phase separator 205 is added to allow liquid to circulate through the boiling passages.

Finally, one may choose to heat-integrate other streams within the subject exchanger to improve efficiency. This concept is illustrated in FIG. 2*d*. Here passages of the exchanger are allocated for superheating the low pressure waste and high pressure waste as well as passages for subcooling the crude liquid oxygen.

A shortcoming with the embodiment shown in FIG. 2*a* is that it suffers from a lower oxygen recovery because the nitrogen purity of the low pressure waste stream, in line 308, is limited by the purity of the top liquid reflux to stripping dephlegmator 204. As shown in FIG. 3*a*, this shortcoming can be circumvented if the high pressure waste stream is liquefied and subsequently used as a reflux instead of the crude liquid oxygen. With reference to FIG. 3*a*, rectification dephlegmator 602 is shortened to accommodate condensing section 603 in the same passage. Within condensing section 603, the high pressure vapor (what had previously been called the high pressure waste stream in FIG. 2*a*) is converted to liquid by removing heat through indirect heat exchange with the top section of stripping dephlegmator 604. This liquefied stream, in line 316, (also referred to as liquid nitrogen reflux) is reduced in pressure across J-T valve 317 and introduced as reflux to the top of supplemental rectification column 605 (this rectification column replaces phase separator 203 in 2A). As shown, the crude liquid oxygen is fed, via line 306, to the sump of rectification column 605 as is the vapor, in line 318, from stripping dephlegmator 604. In rectification column 605, the rising vapor is fractionated against the falling reflux. The result of the addition of rectification column 605 into the process is that the nitrogen purity of the low pressure waste, in line 508, is significantly improved and the oxygen recovery increases. On the other hand, the high pressure waste stream no longer exists. Therefore, a higher pressure nitrogen product must be produced from the low pressure waste via a compression step. Often times, however, there is no use for high pressure nitrogen. Nevertheless, the benefit of increased oxygen recovery dominates and the embodiment of FIG. 3*a* is very efficient (for the production of 85% to 98% purity oxygen).

There are a number of variants to the embodiment of FIG. 3*a*. Extensions include: withdrawing liquid oxygen product and vaporizing in the subject core (analogous to FIG. 2*c*), and heat integrating the crude liquid oxygen subcooling and/or low pressure waste superheating into the subject core (analogous to FIG. 2*d*).

Figure 3B:
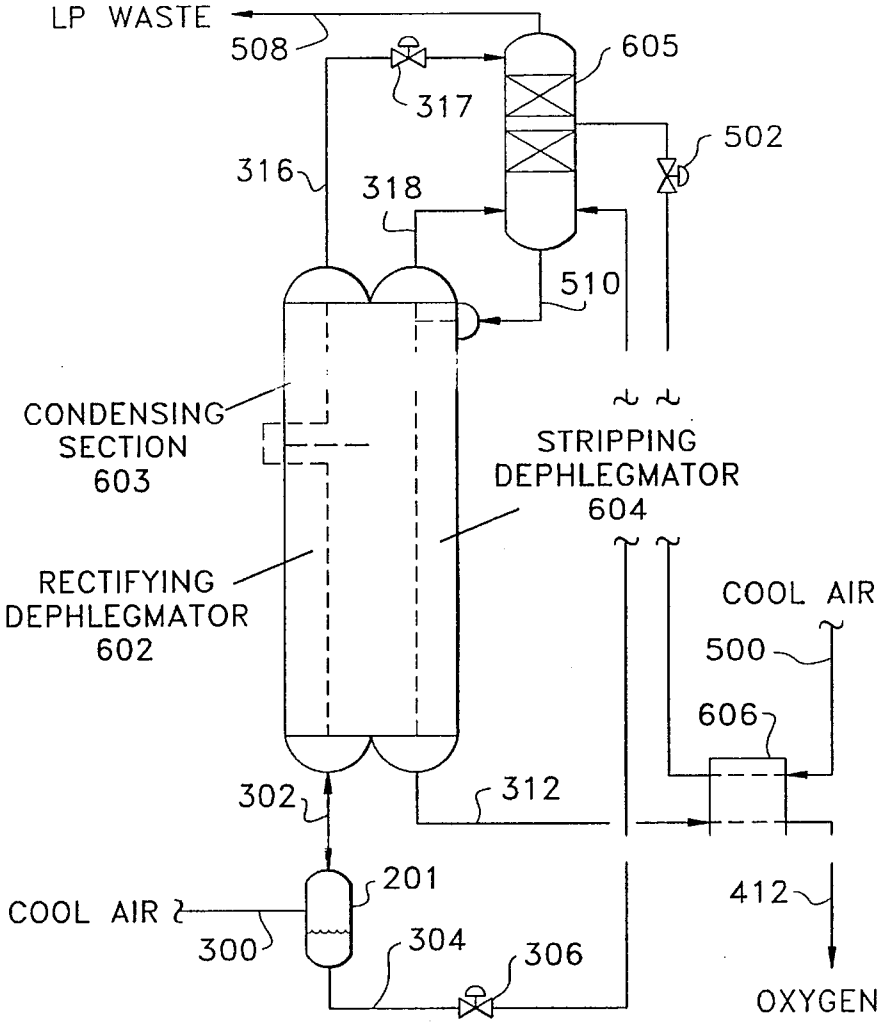
Figure 3A:
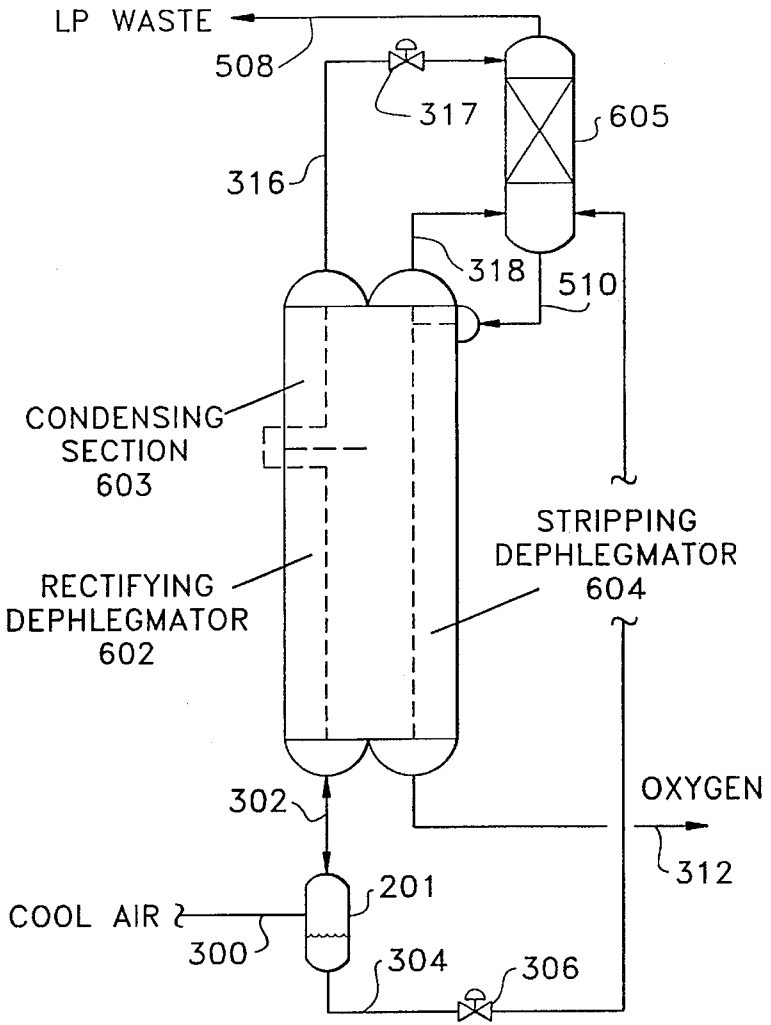

Another extension to the embodiment of FIG. 3*a* is shown in FIG. 3*b*. With reference to FIG. 3*b*, the oxygen product is withdrawn via line 312 as a liquid and vaporized in exchanger 606 against an incoming air stream in line 500. This air stream, after leaving exchanger 606, is reduced in pressure across valve 502 and fed to supplemental rectification column 605 as a feed intermediate to the liquid nitrogen reflux and the crude liquid oxygen. Operation in this mode offers the advantage that the oxygen delivery pressure can be selected independent of the stripping dephlegmator pressure. For example, the oxygen delivery pressure may be increased (via a pump, not shown) or decreased (via a throttling (J-T) valve, not shown). The pressure of the condensing air stream in line 500 will vary to accommodate the selected pressure of the boiling oxygen product, hence the pressure of the condensing air is decoupled from the pressure of the main air.

Figure 3C:
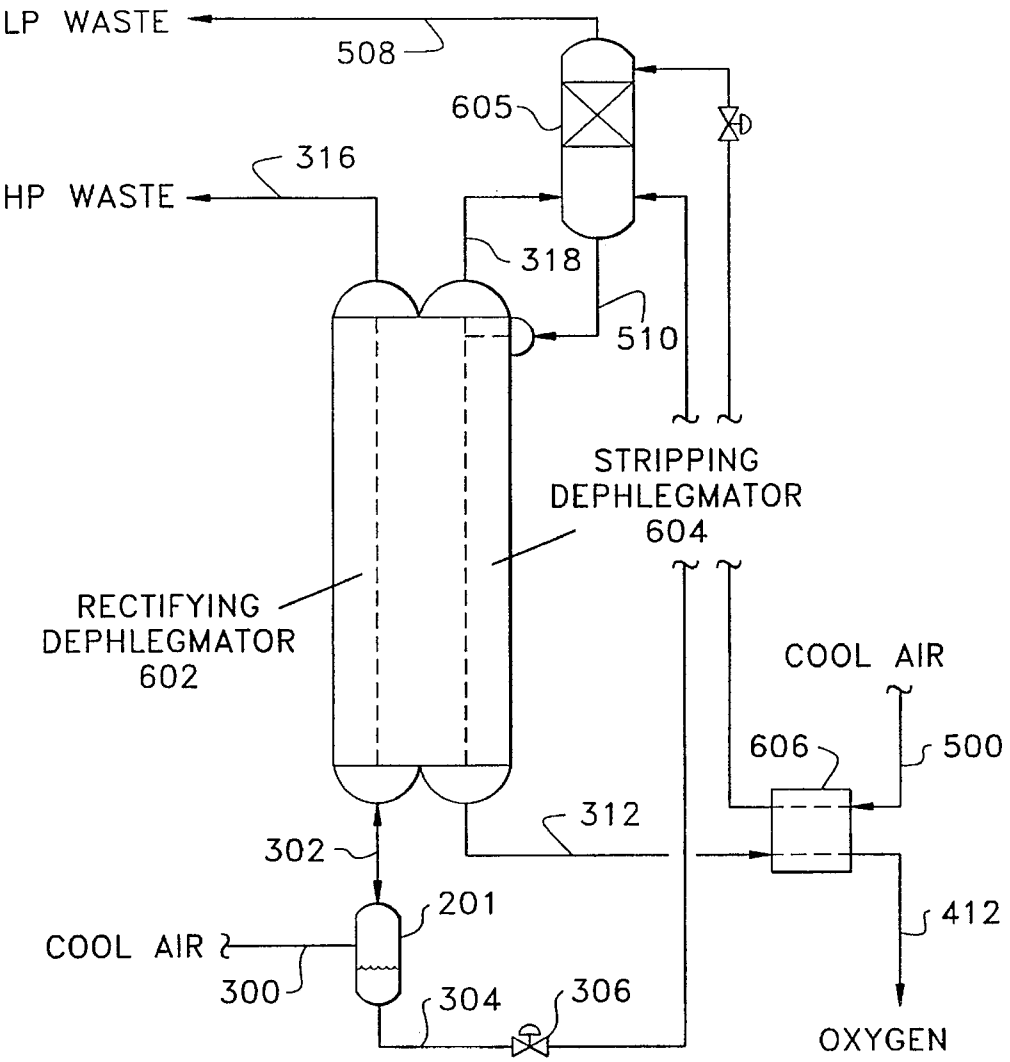

A hybrid of the embodiment shown in FIG. 2*a* and 3*b* is shown in FIG. 3*c*. With reference to FIG. 3*c*, there is no liquid reflux produced, rather the top reflux to rectification column 305 is provided by the air which was liquefied in exchanger 606. The recovery of the embodiment of FIG. 3*c* is intermediate between those of FIG. 2*a* and FIG. 3*b*. However, the FIG. 3*c* embodiment has the benefit of producing a pressurized nitrogen-rich waste stream which may be considered a useful product.

Dual Dephlegmator Mechanical Configuration

Returning to FIG. 3*a*, the heat exchanger (i.e., the heat exchanger embodied by rectification dephlegmator 602, condensing section 603 and stripping dephlegmator 604) is constructed by alternating high pressure (H) and low pressure (L) passages. The L passages are used to carry-out the stripping dephlegmation (604). The H passages contains two zones. The bottom zone is used to carry-out the rectification dephlegmation (602), and the top zone is used for condensation of reflux (603). In the preferred configuration, there are an equal number of L and H passages and the fin height of the L passage is preferably 30% to 40% taller than the fin height of the H passage.

Figure 4C:
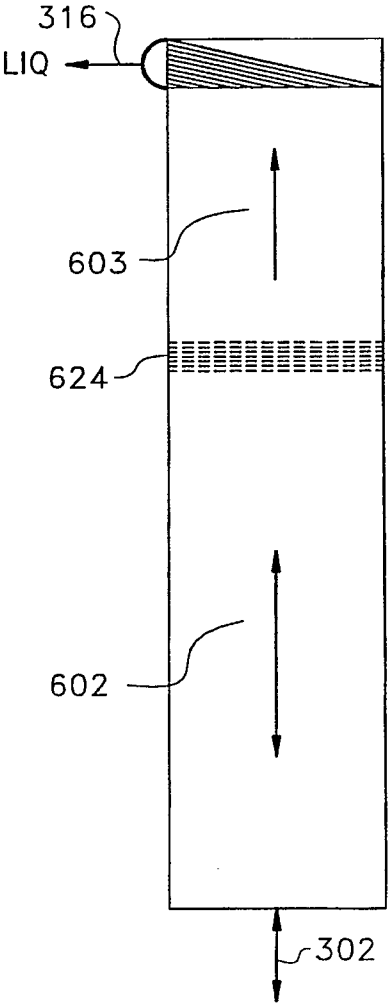
FIGS. 4*a* through 4*c* illustrate three (3) methods for separating the rectifying and condensing zones of a high pressure passage of the dephlegmator of the present invention.
Figure 4B:
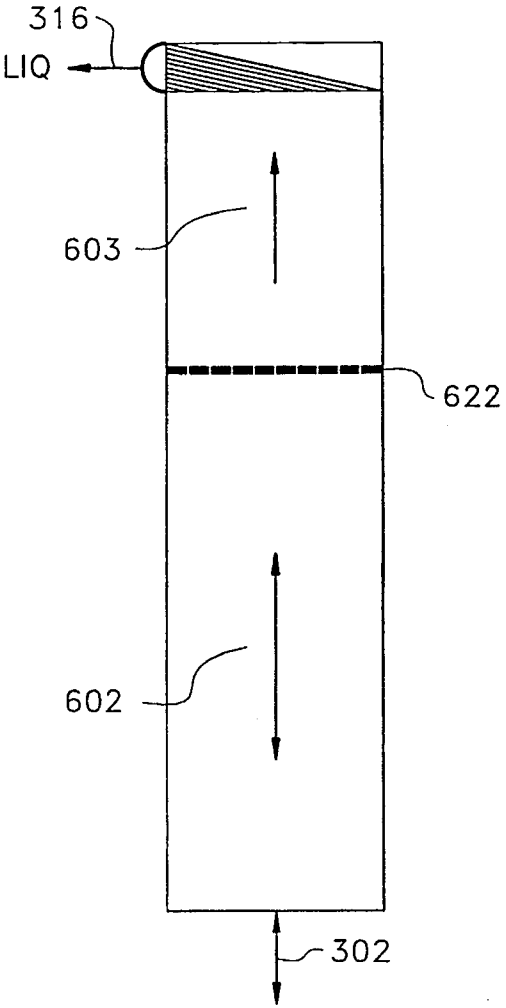
Figure 4A:
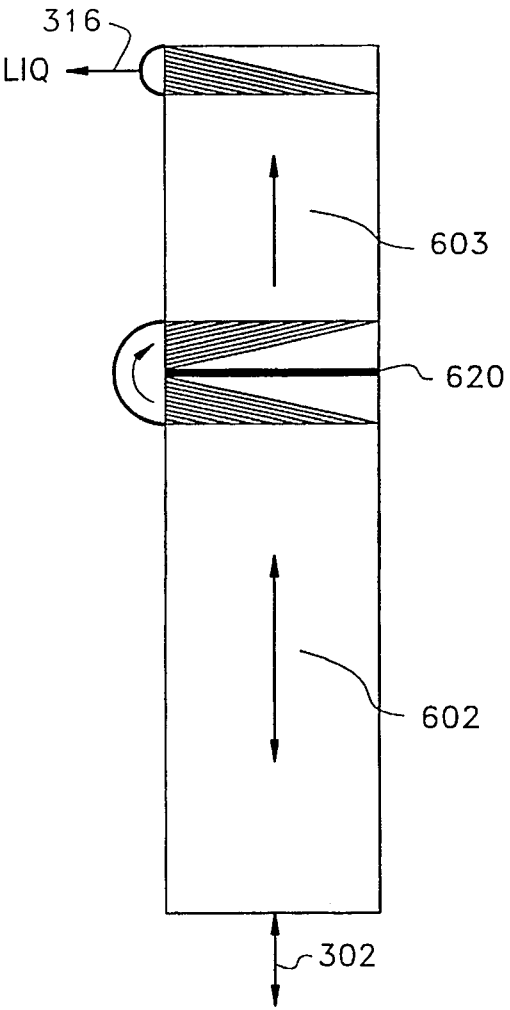

The separation of zones in the H passage may be accomplished in many ways; three of which are shown in FIGS. 4*a* through 4*c:*

With respect to FIG. 4*a*, the H passage may contain solid bar 620 extending across the width of the passage. In this case, distributor fin is used to direct the vapor flow out of dephlegmator zone 602 and in to condensing zone 603. The vapor may enter condensing zone 603 from the bottom (as shown) or through the top.

With respect to FIG. 4*b*, the H passage may contain slotted (or holed) bar 622. The purpose of the holes/slots is to create high vapor velocity. With sufficient vapor velocity, liquid produced in condensing zone 603 is kept from draining into dephlegmator zone 602.

With respect to FIG. 4*c*, the H passage may contain fin material oriented in the "hardway" direction. The hardway fin, which may be of the serrated or perforated type, creates high vapor velocity which keeps the liquid produced in condensing zone 603 from draining into dephlegmator zone 602.

The distributor type shown in FIG. 4a should be used if the production facility will see large variations in flow, particularly, when the inlet to the condensing zone is at the top (not shown) and liquid outlet is at the bottom of the condensing zone. The other two arrangements are functionally equivalent and are useful when the facility operates with modest flow variation. These later two designs are most economic to construct and will yield superior thermal performance because the vapor condenses countercurrent to the boiling liquid in the adjacent stripping dephlegmator.

The type of outlet distributor used for discharging the liquid from the condensing zone of the H passage is not key to performance of the dephlegmator system. However the preferred orientation is side-exit as illustrated in FIGS. 4*a* through 4*c*.

Figure 5C:
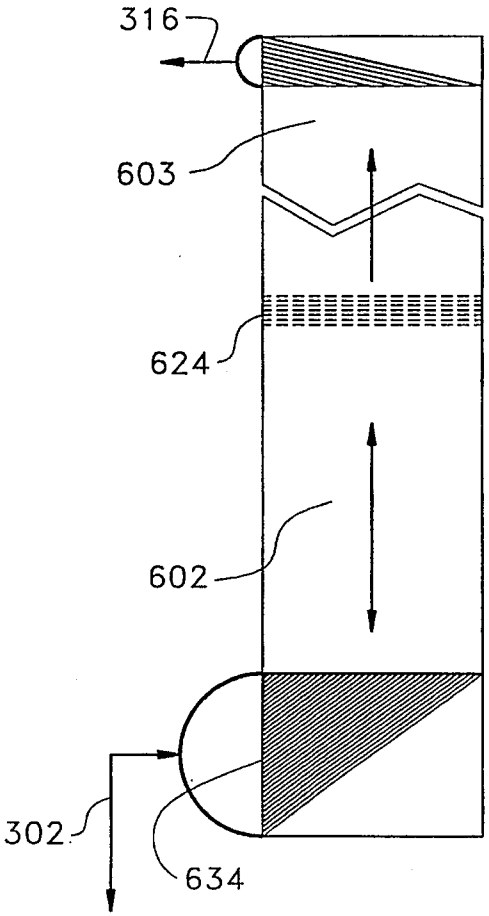
FIGS. 5*a* through 5*c* illustrate three (3) distributor designs for the bottom of the rectifying passage of the dephlegmator of the present invention.
Figure 5B:
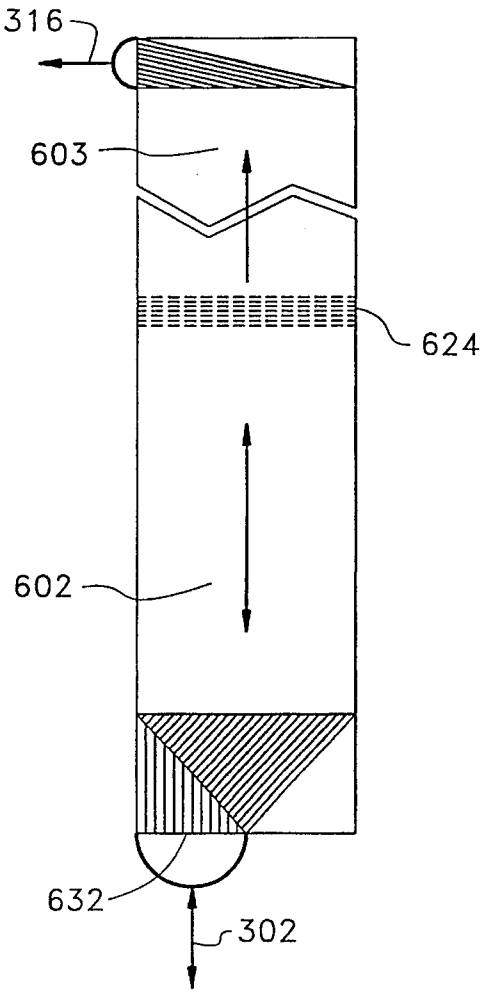
Figure 5A:
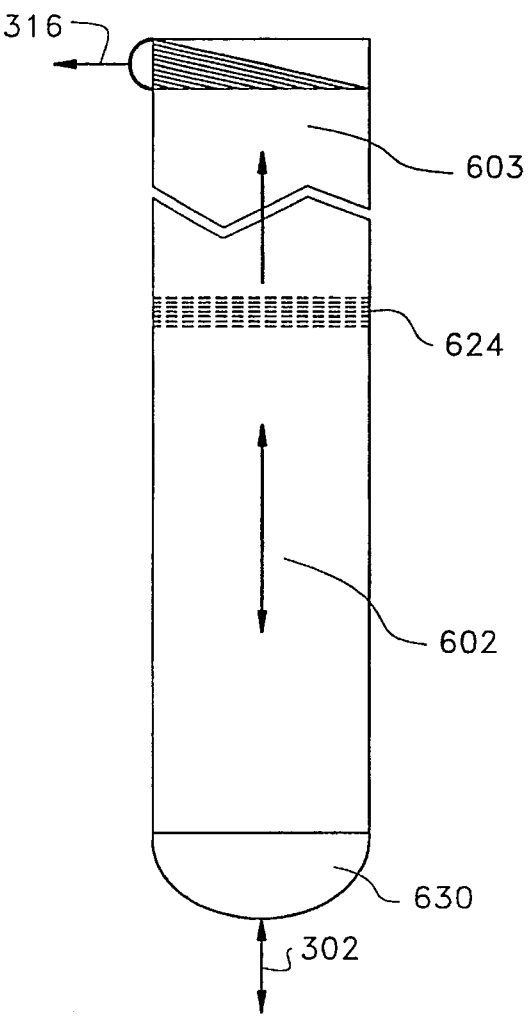

Different types of distributors may be used at the bottom of the dephlegmator zone in the H passage as shown in FIGS. 5*a* through 5*c:*

As shown in FIG. 5*a*, the preferred configuration, no distributor fin should be used and header 630 should cover the entire width of the passage. This configuration results in the highest flow capacity and is the preferred distributor because restricting flow area reduces the capacity in the dephlegmator section.

If for some reason one cannot use a full coverage header, then other types may be employed. In FIG. 5*b*, the use of a partial coverage, end-header and associated distributor 632 is illustrated. This design lowers the capacity of the rectification dephlegmator but may be necessary if one needs to install an additional end-header for some other process stream.

In FIG. 5*c*, a third alternative is shown, i.e., the use of a side-header and associated distributor 634. This design has the lowest capacity of the three but may be necessary if the bottom of the core is covered by the header of an even more critical stream.

Although not shown, it may be convenient to make the air feed separator (e.g., unit 201, FIG. 2) part of any one of the leaders depicted in FIGS. 5*a* through 5*c*.

The L passage is used exclusively for the stripping dephlegmator. The liquid is introduced to the top of the passage via some appropriate means such as a liquid injection tube or other device. Although the liquid distribution device is not the subject of this disclosure, different devices may be envisioned such as injection tube(s), dual-flow slotted bars, and split passages. Split passage designs have been used by various vendors for two-phase distribution.

Figure 6C:
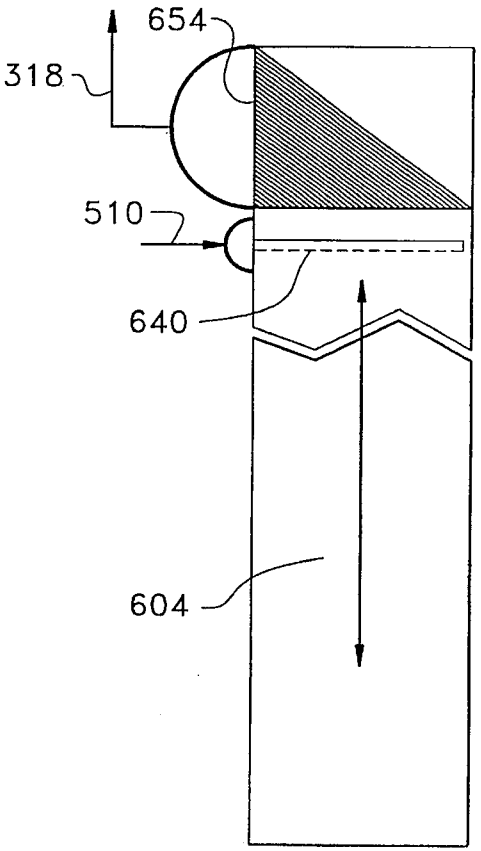
FIGS. 6*a* through 6*c* illustrate three (3) distributor designs for the top of the stripping passage of the dephlegmator of the present invention.
Figure 6B:
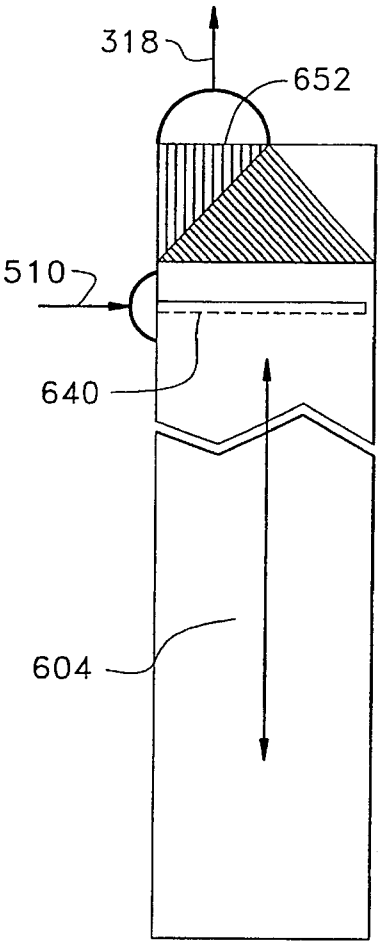
Figure 6A:
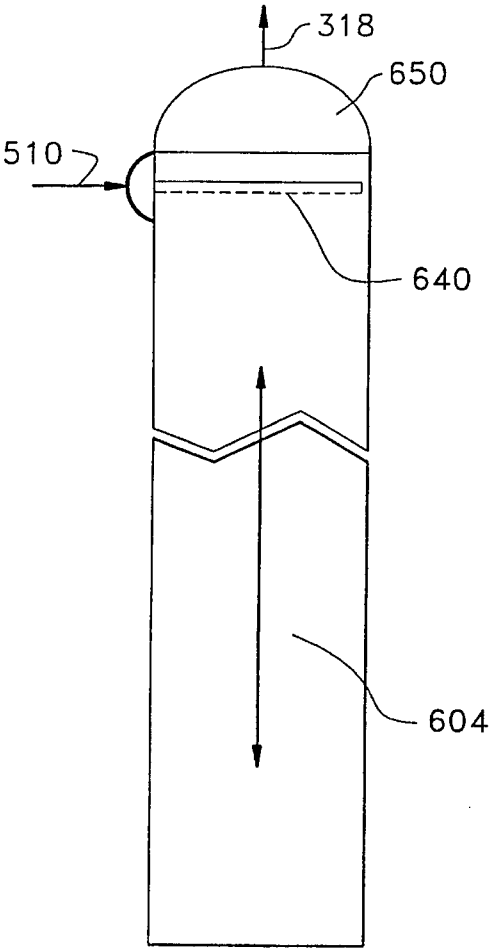

The vapor leaving the L passage may exit from the top using different types of distributors as shown in FIG. 6:

As shown in FIG. 6*a*, in the preferred configuration, no distributor fin should be used and header 650 should cover the entire width of the passage. This configuration provides the maximum amount of exchanger length for dephlegmation.

If for some reason one cannot use a full coverage header, then other types may be employed. In FIG. 6*b*, the use of a partial coverage, end-header and associated distributor 652 is illustrated. This design reduces the mass transfer effectiveness by consuming dephlegmation length but may be necessary if one needs to install an additional end-header for some other process stream.

In FIG. 6*c*, a third alternative is shown, i.e., the use of a side-header and associated distributor 654. This design may be necessary if the top of the core is covered by the header of an even more critical stream.

Figure 7C:
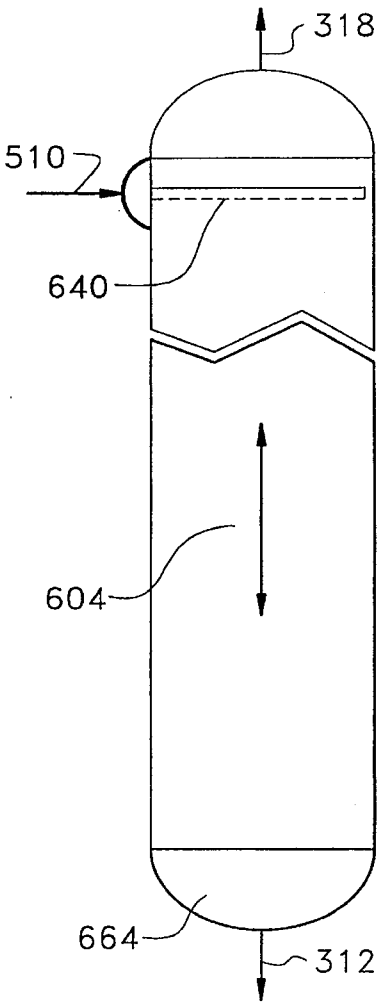
FIGS. 7*a* through 7*c* illustrate three (3) distributor designs for the bottom of the stripping passage of the dephlegmator of the present invention.
Figure 7B:
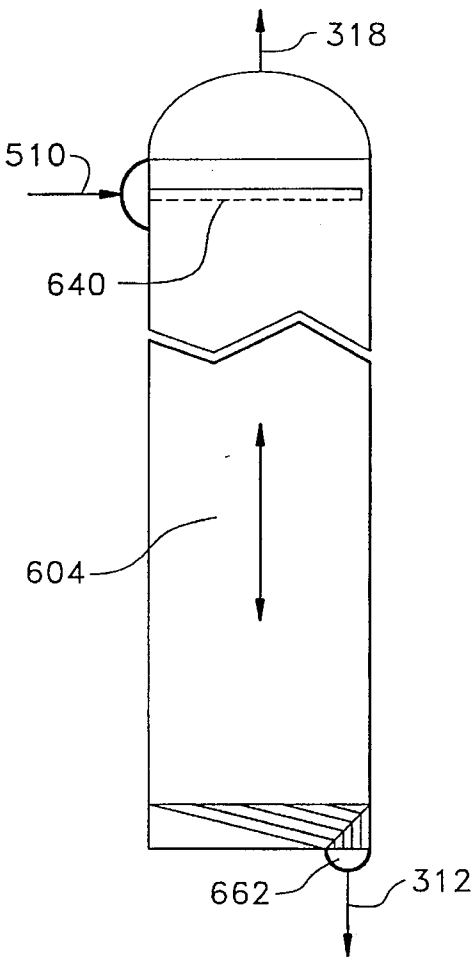
Figure 7A:
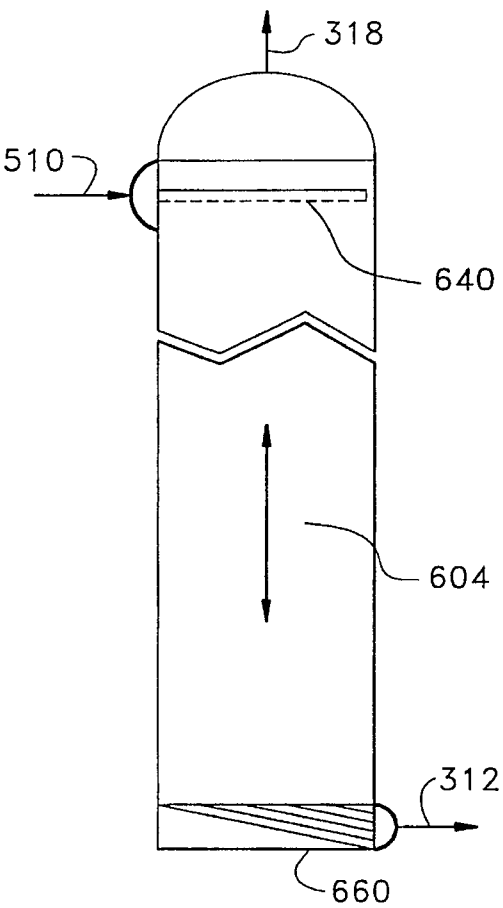

The liquid leaving the bottom of the stripping dephlegmator (L passage) may be withdrawn using any number of distributor concepts as illustrated in FIGS. 7*a* through 7*c*. The exact configuration is unimportant and the type used will depend on how the H passage is configured.

Process Application

Figure 8:
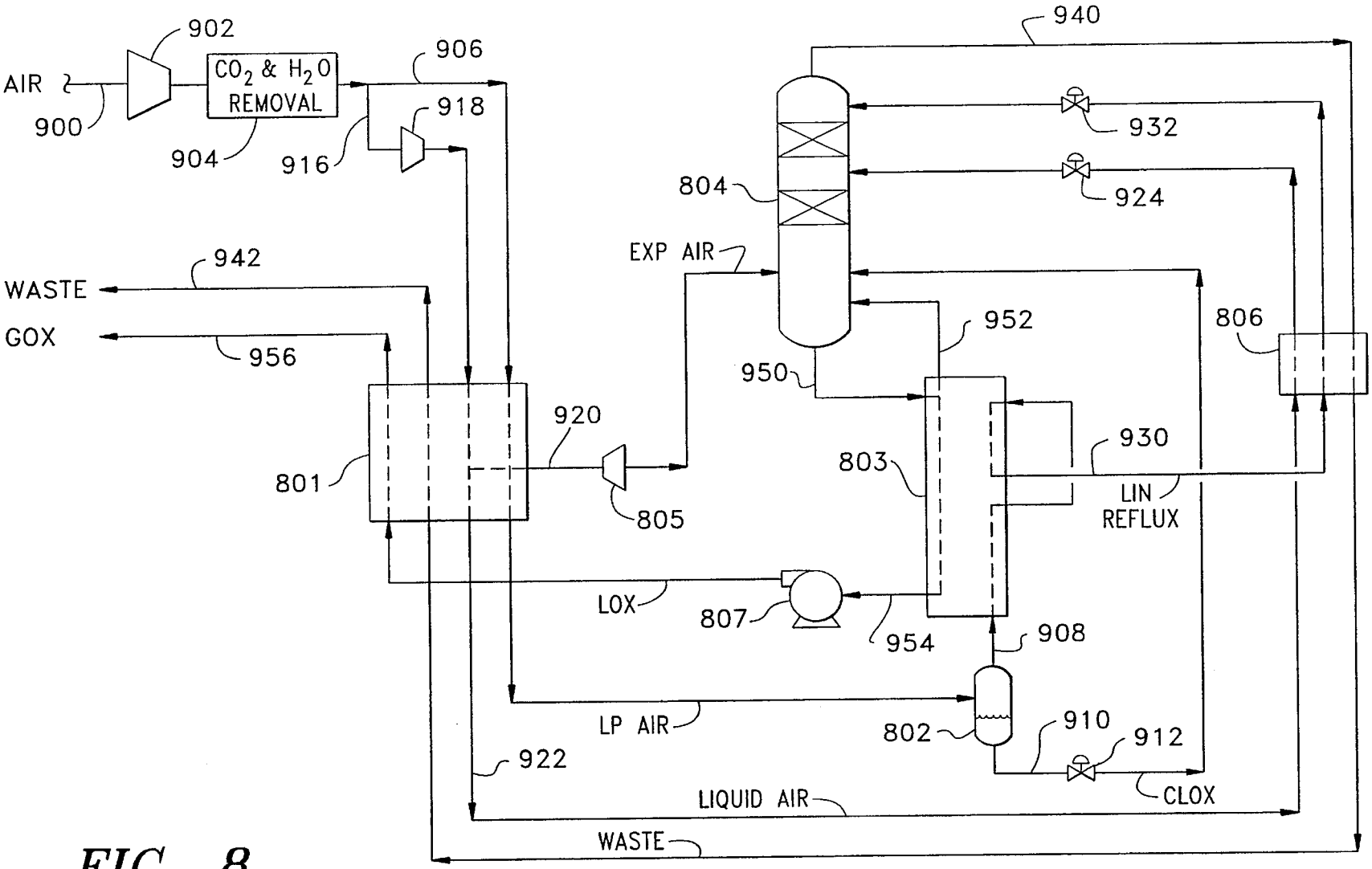
FIG. 8 is a schematic drawing an air expander dephlegmator process embodiment of the present invention.

An application of the dual dephlegmator to air separation is shown in FIG. 8. With reference to FIG. 8, a cryogenic process embodiment for producing medium purity oxygen is shown. The process embodiment is capable of producing oxygen with a purity between 40% and 98% with the preferred range being 85–98%. This particular process embodiment utilizes "pumped-liquid oxygen" principles so that oxygen may be delivered to the customer at modest pressure without compression of the oxygen product (25–30 psia). In the embodiment, feed air is fed to the cold box at two pressure levels and fractionated to produce oxygen and waste nitrogen. The fractionating equipment consists of dual dephlegmator 803 and supplemental distillation column 804. The third major equipment item is main heat exchanger 801.

Dual dephlegmator 803 is constructed from a plate-fin exchanger. One set of passages is used to perform the function of a rectification dephlegmator (the high pressure column in a conventional dual-column system), as well as the liquid nitrogen reflux condenser. The adjacent set of passages is used to perform the function of the stripping dephlegmator (the bottom (stripping section) of the low pressure column in a conventional dual-column system).

In FIG. 8, air, in line 900, is compressed in two stages to between 45 and 55 psia in compressor 902, then passed-through front-end cleanup system 904 to remove water and carbon dioxide. The clean gas is then split into two, roughly equal, portions. One portion, the medium pressure air, in line 906, is cooled in main exchanger 801 and sent to phase separator 802.

The second portion of air, in line 916, is further compressed in compressor 918 which can be a third stage of compressor 902, to about 80 psia, and then cooled in main heat exchanger 801. Some of this cooled high pressure air is withdrawn from a midway point of main heat exchanger 801 via line 920 and expanded in expander 805 to provide cold box refrigeration to combat heat leak or produce liquid. The remainder of the second portion is condensed in main heat exchanger 801. Eventually, both the expanded air, in line 920, and the liquefied air, in line 922, are both fed to (low pressure) distillation column 804.

The vapor fraction from phase separator 802 is fed to the bottom of the rectification dephlegmator passages contained within exchanger 803. As the vapor flows upward, it is partially condensed. This condensate flows countercurrent to the rising vapor and eventually drains from the bottom of the rectification dephlegmator passages via line 908 into phase separator 802.

The liquid fraction from phase separator 802, in line 910, (referred to as the "CLOX"), is flashed across valve 912 and fed to the sump of distillation column 804.

The vapor from the top of the rectification dephlegmator passages is withdrawn from midway up exchanger 803 and then condensed (as a downward flow) within the condensing zone of exchanger 803. The condensate, in line 930, (referred to as the "LIN reflux") is subcooled in exchanger 806, throttled across valve 932, and fed to the top of supplemental distillation column 804 as top reflux.

Supplemental distillation column 804 consists of two (2) sections. The top section is refluxed with the LIN reflux, and the bottom section is refluxed with the liquid air which was condensed in main heat exchanger 801. The purpose of this column (804) is to minimize the oxygen losses to the low pressure waste stream, which exits the top of the column as overhead vapor via line 940. This waste stream, which typically contains 1–5% oxygen, is warmed in exchangers 806 and 801 and then used to regenerate front-end cleanup unit 904.

An oxygen-enriched liquid stream is removed via line 950 from the bottom of supplemental distillation column 804 and distributed into the top of the stripping dephlegmator passages of exchanger 803. As this liquid flows downward within these passages it is partially vaporized. The vaporized material flows countercurrent to the draining liquid and ultimately exits from the top of the stripping passages. This vapor, in line 952, is fed to the sump of supplemental distillation column 804.

The liquid that exits via line 954 from the bottom of the stripping dephlemator passages of exchanger 803 constitutes the oxygen product. This liquid oxygen stream is pumped in pump 807 to about 25 to 30 psia, vaporized and warmed to recover refrigeration and delivered as a gaseous oxygen product. There are a number of variations on the basic cycle shown in FIG. 8. Two important variants include:

If the required pressure of the oxygen product (line 956) is low (e.g., a few psi above atmospheric), there would be no need to pump the liquid oxygen in pump 807. Further, there would be no need for air booster compressor 918; therefore, air feed streams 906 and 916 would be combined and partially condensed in the main exchanger.

If the required pressure of the oxygen product (line 956) is very high and oxygen recovery needs to be increased, the further compressed, cooled, feed air portion, in line 920 could be expanded into phase separator 802 instead of into supplemental distillation column 804.

Although the concept of using a dual dephlegmator for the production of oxygen has been suggested in the art, the previous teachings failed to propose a commercially viable mechanical means and process to achieve the goal.

For example, the embodiment of FIG. 2*a* differs from U.S. Pat. No. 2,861,432 by using plate-fin exchanger with vertical fins versus the use of overflow packing. The advantages of the present invention are:

The vertical arrangement yields true countercurrent heat and mass transfer rather than the "approximation" produced with the overflow packing.

Greater open area for vapor flow leads to greater capacity.

More fin surface area yields better heat transfer and closer temperature approaches.

Vertical fins are free draining and don't present low points for heavy impurities to accumulate under evaporative conditions.

The fin heights and fin frequency of individual rectifying and stripping passages may be selected to yield the same approach to capacity limits. For example, the fin heights of the HP circuit should be less than that of the LP circuit.

The inclusion of an adiabatic zone for the stripping dephlegmator is easily accomplished by simply terminating the rectification dephlegmator below the top of the exchanger.

The plate-fin device is a more commercially practical design and is mechanically more robust (overflow packing has upper limits on operating pressure).

Also, the embodiment of FIG. 3*a* further differs from U.S. Pat. No. 2,861,432 in that the embodiment of FIG. 3*a* has the condenser incorporated into the plate-fin exchanger versus running condenser tubes through trays. The advantages of the present invention are:

Equipment is simplified and costs are reduced.

Performance is better because the liquid only needs to be distributed once. In the present invention, the stripping dephlegmator consists of a single section, however, U.S. Pat. No. 2,861,432 teaches the use of a combination of trays and overflow packing.

The condensing section lies spatially on top of the rectification dephlegmator so exchanger volume is most effectively utilized.

The present invention differs from U.S. Pat. No. 4,025,398 in that it uses a plate-fin exchanger with vertical fins while U.S. Pat. No. 4,025,398 uses heat transfer devices running between columns. Aside from the obvious equipment simplification of the present invention, the present invention provides true counter-current heat transfer while U.S. Pat. No. 4,025,398 has quasi-countercurrent flow from discreet unit operations in series. Therefore, the present invention design can achieve closer temperature approaches between the rectification dephlegmator and stripping dephlegmator passages.

The present invention differs from U.S. Pat. No. 3,756,035 in that U.S. Pat. No. 3,756,035 teaches the compression of the nitrogen-rich stream from rectification dephlegmator before condensing it against refrigeration from the stripping dephlegmator. Furthermore, the condensation step of U.S. Pat. No. 3,756,035 is spatially located below rectification dephlegmator. This is opposite of the present invention as depicted in FIG. 3*a*. Finally, the present invention is simpler and more efficient.

Finally, the present invention as depicted in FIG. 8 additionally differs from U.S. Pat. No. 2,861,432 in that the present invention draws the expander flow from the high pressure air stream. U.S. Pat. No. 2,861,432 teaches that the optimal arrangement is to draw expander flow from the low pressure air. The present invention teaches that the opposite is true. Simulation calculations for the embodiment of FIG. 8 show that the plant capacity (moles of oxygen produced per mole of air) declines by 13% and the specific power increases by 4% when the expander is moved from the high pressure air source to the low pressure air source.

The present invention has been described with reference to several specific embodiments. These embodiments should not be viewed as a limitation of the present invention, the scope of which should be ascertained from the following claims.

We claim:

1. A cryogenic process for production of an oxygen product from air, wherein the air is compressed, purified to remove contaminants which freeze out at cryogenic temperatures and cooled to near its dew point, wherein the cooled, purified, compressed air is fed to a separator, wherein separator vapor is rectified into a nitrogen-enriched rectifier overhead and a crude liquid oxygen bottoms; wherein an oxygen-enriched liquid is stripped to produce a nitrogen-enriched stripper overhead and the oxygen product, characterized in that a multiple passage plate-fin heat exchanger having at least two sets of passages is used to effectuate the rectifying and stripping functions, wherein one set of passages comprises a continuous-contact rectification dephlegmator which rectifies the separator vapor and produces the enriched-nitrogen rectifier overhead and the crude liquid oxygen bottoms; wherein a second set of passages comprises a continuous-contact stripping dephlegmator which strips the oxygen-enriched liquid to produce the nitrogen-enriched stripper overhead and the oxygen product; wherein reflux of the rectification device and boilup for the stripping device is provided, at least in part, by indirect heat exchange between and along said two sets of passages, thereby producing a thermal link between the rectification dephlegmator and the stripping dephlegmator.

2. The process of claim 1 wherein the oxygen product is removed from the stripping dephlegmator as a liquid.

3. The process of claim 1 wherein the oxygen product is removed from the stripping dephlegmator as a gas.

4. The process of claim 1 wherein the oxygen-enriched liquid is the crude liquid oxygen bottoms.

5. The process of claim 1 wherein the first set of passages further comprise a condensing zone located above the rectification dephlegmator; wherein the nitrogen-enriched rectifier overhead is at least partially condensed in the condensing zone and wherein the refrigeration is provided, at least in part, by indirect and continuous heat exchange with an upper portion of the second set of passages, thereby producing a thermal link between the condensing zone and the stripping dephlegmator.

6. The process according to claim 5, wherein the crude liquid oxygen bottoms from the rectification dephlegmator, the at least partially condensed nitrogen-enriched rectifier overhead from the condensing zone, and the nitrogen-enriched stripper overhead are fed to a distillation column for fractionation, thereby producing a waste nitrogen-enriched overhead and the oxygen-enriched liquid.

7. The process of claim 6 wherein the oxygen product is liquid; wherein the oxygen product is subsequently vaporized by heat exchange against a second air stream which is condensed by the heat exchange and wherein the condensed second air stream is used as an intermediate feed to the distillation column.

8. The process of claim 7 wherein the purified, compressed air is split into two portions before cooling, wherein the first portion is cooled and fed to the separator, wherein the second portion is further compressed, cooled and split into two substreams; wherein the first substream is the second air stream which is condensed against the vaporizing oxygen product and wherein the second substream is expanded to recover work prior to being fed to the distillation column.

9. The process according to claim 2 wherein the crude liquid oxygen bottoms and a liquefied air stream are fed to the distillation column for fractionation thereby producing a nitrogen-enriched waste stream and the oxygen-enriched liquid that is fed to the stripping dephlegmator; and wherein the liquefied air stream is produced by heat exchange with the oxygen product.

10. The process according to claim 6 wherein the oxygen product is a liquid which is vaporized within a third set of passages in the multiple passage plate-fin heat exchanger to produce a vapor and wherein the heat of vaporization is provided, at least in part, by heat exchange with the rectification dephlegmator passages.

11. The process according to claim 7 wherein the liquid oxygen product is pumped to elevated pressure prior to being vaporized.

12. The process according to claim 8 wherein the liquid oxygen product is pumped to elevated pressure prior to being vaporized.

13. A process according to claim 1 wherein the rectification dephlegmator passages are shorter in length than the stripping dephlegmator passages and arranged so as to produce an adiabatic zone within the top of the stripping dephlegmator passages.

14. A process according to claim 1 wherein the heat exchanger comprises at least three sets of passages, wherein the enriched-nitrogen rectifier overhead is warmed to recover refrigeration in the third set of passages.

15. A process according to claim 1 wherein the heat exchanger comprises at least three sets of passages, wherein the crude liquid oxygen is cooled in the third set of passages.

16. A process according to claim 1 wherein the heat exchanger comprises at least four sets of passages, wherein the enriched-nitrogen rectifier overhead is warmed to recover refrigeration in the third set of passages and the crude liquid oxygen is cooled in the fourth set of passages.

17. A cryogenic oxygen production apparatus comprising a multiple passage plate-fin heat exchanger having at least two sets of vertically oriented passages separated by parting sheets and having a bottom and a top, wherein the first set of passages comprises a continuous-contact rectification dephlegmator zone containing finnings and a condensing zone which is located above and separated from the rectification dephlegmator zone; wherein the second set of passages comprises a continuous-contact stripping dephlegmator zone; wherein the first and second set of passages are arranged such that each passage of said first set of passages is in thermal communication across a parting sheet with at least one passage of said second set of passages; two phase distributing means to introduce vapor into the bottom of and remove liquid from the first set of passages and a distributing means to introduce liquid into the top of the second set of passages and remove vapor.

18. An apparatus according to claim 17 further comprising a solid bar separating the rectification dephlegmator zone and the condensing zones and a collecting-distributing means running between the top of the rectification dephlegmator zone and the top of the condensing zone.

19. An apparatus according to claim 17 further comprising a bar containing apertures separating the rectification dephlegmator zone and the condensing zones.

20. An apparatus according to claim 17 further comprising a perforated or serrated finning material oriented horizontally separating the rectification dephlegmator zone and the condensing zones.

* * * * *